United States Patent [19]

Akimura et al.

[11] 4,452,882

[45] Jun. 5, 1984

[54] SILVER HALIDE PHOTOGRAPHIC MATERIALS AND PROCESS OF DEVELOPING THEM

[75] Inventors: Yoshitaka Akimura; Eiichi Okutsu; Shigenori Moriuchi; Naomi Saeki; Taiji Hashimura; Hiroyuki Mifune, all of Minami-ashigara, Japan

[73] Assignee: Fuji Photo Film Co., Ltd., Kanagawa, Japan

[21] Appl. No.: 489,907

[22] Filed: Apr. 29, 1983

[30] Foreign Application Priority Data

Apr. 30, 1982 [JP] Japan ..... 57-72916

[51] Int. Cl.[3] ..... G03C 5/30; G03C 1/06

[52] U.S. Cl. ..... 430/441; 430/265; 430/266; 430/267; 430/438; 430/446; 430/567; 430/569; 430/602; 430/605; 430/608; 430/611; 430/613; 430/949

[58] Field of Search ..... 430/949, 567, 569, 602, 430/637, 605, 611, 608, 613, 265, 266, 267, 268, 441, 438, 446

[56] References Cited

U.S. PATENT DOCUMENTS

| | | | |
|---|---|---|---|
| 2,448,060 | 8/1948 | Smith et al. | 430/605 |
| 3,488,709 | 1/1970 | Sidebotham | 430/608 |
| 4,011,082 | 3/1977 | Sakai et al. | 430/567 |
| 4,346,167 | 8/1982 | Imatomi et al. | 430/605 |

FOREIGN PATENT DOCUMENTS

| | | |
|---|---|---|
| 125734 | 10/1981 | Japan . |
| 149030 | 11/1981 | Japan . |
| 149031 | 11/1981 | Japan . |

*Primary Examiner*—Mary F. Downey

*Attorney, Agent, or Firm*—Sughrue, Mion, Zinn, Macpeak & Seas

[57] ABSTRACT

A silver halide photographic light-sensitive material and a developing process used in connection with that material are disclosed. The material is comprised of a support having thereon a silver halide emulsion layer containing a silver halide emulsion in which at least 80 mole % of the whole silver halide is composed of silver chloride, the mean grain size thereof is less than 0.4 μm, and which contains more than $1\times10^{-6}$ mole of a water-soluble rhodium salt per mole of silver at an optional period before finishing the first ripening in the production step for the silver halide emulsion. The material also contains $1\times10^{-5}$ to $1\times10^{-2}$ mole of polyalkylene oxide having a molecular weight of at least 600 or a derivative thereof per mole of silver. The process involves imagewise exposing the material and processing it in a developer containing 0.05 to 0.5 mole/liter of a dihydroxybenzene series developing agent, 0 to 0.05 g/liter of an auxiliary developing agent, at least 0.25 mole/liter of a free sulfite ion, at least 20 mg/liter of 5- or 6-nitroindazole, and an alkali of an amount sufficient for keeping the pH of the developer higher than 10.5. The material and processing are capable of providing good letter image quality in a short developing time.

10 Claims, 1 Drawing Figure

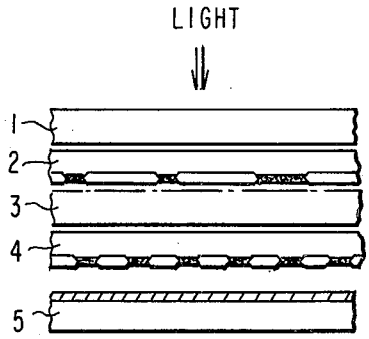
LIGHT
1
2
3
4
5

SILVER HALIDE PHOTOGRAPHIC MATERIALS AND PROCESS OF DEVELOPING THEM

FIELD OF THE INVENTION

This invention relates to silver halide photographic light-sensitive materials and a process of developing them, and, more particularly, to silver halide photographic light-sensitive materials capable of being handled in an area generally referred to as a bright room and a process of developing them.

BACKGROUND OF THE INVENTION

A photographic material has been hitherto researched to make it possible to carry out contact exposure work (so-called contact work step) with a photographic light-sensitive material having a relatively low sensitivity in a bright room when manufacturing printing plate. A photographic light-sensitive material which can be handled in an area generally referred to as a bright room while using silver halide as the light-sensitive element has recently been developed. This is attained by exposing a light-sensitive material having an extremely low sensitivity (e.g., about $1/10^4$ which is the sensitivity of an ordinary silver halide photographic material) with respect to visible light to a light source containing a large amount of ultraviolet rays under a safety light which substantially emits no ultraviolet rays.

On the other hand, a so-called contact work of reproduction process is performed by not only a simple one-sheet contact reproduction work (i.e., a step of performing a nega-posi transformation by contact-exposing reproduction film for contact work using one-sheet of developed film as the original, and developing the light-sensitive silver halide material), but also advanced image transformation referred to a "image-letter superimposition".

The image-letter superimposition means a step conducted in contact work for making non-inked portion of a letter, symbol, etc. (called "letter image"), existing in a print at the portion of ink dots on paper (dot-image portion) and the wholly inked portion (called "solid black" portion). The image-letter superimposition during a photomechanical process is more practically explained by referring to the accompanying drawing. That is, as shown in the FIGURE, a superimposed assembly of a developed dot-image-formed film (dot-image original) 4 attached to a transparent or translucent film base (usually, a polyethylene terephthalate film of several hundreds μm in thickness is used) 3 and a developed film 2 having formed thereon a so-called line positive image of a letter or a symbol (line image original) attached to a base film 1 similar to the base film 3 is used as an original. The silver halide emulsion layer of a reproduction light-sensitive film 5 for contact work is brought into contact with the dot-image portion of the original. The reproduction film is light-exposed and developed to form a clear portion of the line image in the dot-images. The important point in the process is that the dot-image and the line image must perform nega-posi transformation according to the dot area and the line width, respectively.

For example, a dot-image having a black area of 50% must be accurately transformed into a white area of 50% and a line image having a black line width of 50 μm must be transformed into a white line having a width of 50 μm. However, as is clear from the FIGURE, while dot-image is exposed on a reproduction film for contact work in a direct contact state with the silver halide emulsion layer of the reproduction film, a line image is exposed on a reproduction film for contact work through the dot-image original 4 (usually having a thickness of about 110 μm) and the base 3 (having a thickness of several hundreds μm) for attaching thereto the dot-image original. More specifically, the line image is exposed on the reproduction film for contact work as a dimmed or indistinct image through a transparent or translucent spacer having several hundred μm thickness. Accordingly, if an ordinary exposure amount (i.e., the exposure amount capable of faithfully performing a nega-posi transformation of dot area) is applied, the clear line width of the line image is narrowed by the influence of the dimmed exposure. On the other hand, if the exposure amount is reduced in order to reduce the influence of the dimmed exposure and perform a faithful nega-posi transformation of the line width of a line image, the dot area becomes narrow due to deficient exposure. This phenomenon is largely influenced not only by a light-sensitive material but also by the exposure light source. That is, if the size of a light source for exposure is as small as a point light source, the extent of the foregoing dimmed exposure can be reduced. However, since an exposure means capable of providing a large amount of exposure must be used when using a light-sensitive material for a bright room, the light source is larger than that of a conventional dark room-type exposure means. This causes deterioration in the quality of the latter image.

There has been substantially no published information with respect to a means for eliminating the deterioration of the quality of the letter image.

Emulsions of silver halide light-sensitive materials which can be handled in a bright room which have therein silver halide grains formed by the addition of a large amount of a rhodium salt are described in, for example, Japanese patent application (OPI) Nos. 125734/81, 149030/81 and 149031/81 (the term "OPI" as used herein refers to a "published unexamined Japanese patent appplication"). However, no techniques for improving the quality of the letter image are described in these specifications of these patent applications. The foregoing patent applications also disclose the addition of polyalkylene oxides to developers. The results of comparison sample I described in Example 1 of the present invention which will be described later in this specification clearly show that the mere addition of a polyalkylene oxide to a developer does not improve the quality of the letter image.

A number of recent attempts have been made to obtain image quality equal to lithographic development by quick and stable processing. There has also been an increase in demand for performing the image-letter superimposition which is a higher image transformation work by similar quick and stable processing. However, no practical techniques for meeting the demand have been developed.

SUMMARY OF THE INVENTION

A first object of this invention is to provide a light-sensitive material having a good letter image aptitude.

A second object of this invention is to provide a light-sensitive material which has a good letter image aptitude and which can be handled in a bright room.

A third object of this invention is to provide a process of obtaining good letter images quickly using a stable processing solution.

The first and second objects of this invention can be attained by using a silver halide light-sensitive material comprising a support having thereon a silver halide emulsion layer containing a silver halide emulsion in which at least 80 mole% of the whole silver halide is composed of silver chloride, the mean grain size thereof is less than 0.4 μm, and which contains more than $1\times10^{-6}$ mole of a water-soluble rhodium salt per mole of silver during an optional period before finishing the first ripening in the production step for the silver halide emulsion, said silver halide light-sensitive material further containing $1\times10^{-5}$ to $1\times10^{-2}$ mole of polyalkylene oxide having a molecular weight of at least 600 or a derivative thereof per mole of silver in the silver halide emulsion layer or other hydrophilic colloid layer.

The third object of this invention can be attained by processing the foregoing silver halide light-sensitive material with a developer containing 0.05 to 0.5 mole/liter of a dehydroxybenzene series developing agent, containing less than 0.05 g/liter of an auxiliary developing agent, containing more than 0.25 mole/liter of a free sulfite ion concentration, containing more than 20 mg/liter of 5- or 6-nitroindazole, and containing a sufficient amount of an alkali for adjusting the pH of the developer above 10.5.

BRIEF DESCRIPTION OF THE DRAWING

The FIGURE is a schematic cross-sectional view showing the relationship between an original used for the image-letter superimposition and a reproduction light-sensitive material for contact work.

DETAILED DESCRIPTION OF THE INVENTION

The silver halide in the silver halide light-sensitive material of this invention is composed of, for example, silver chloride, silver chlorobromide, silver idochloride, or silver iodobromochloride. The silver halide is comprised of at least 80 mole% silver chloride. Preferably, the silver halide is comprised of at least 90% silver chloride and particularly preferably more than 95 mole% silver chloride.

The mean grain size of the silver halide in this invention is less than 0.4 μm, particularly preferably less than 0.3 μm. "Mean grain size" is a term usually used by those skilled in the field of silver halide photographic science. The grain size means the diameter of a grain when the grain is a spherical grain or a grain similar to a sphere. If the grain is a cube, the grain size of the grain is edge length$\times\sqrt{(4/\pi)}$. The mean grain size is determined by an algebraic mean or geometrical mean based on the projection area for mean grain size. A method of determining the mean grain size is described in detail in, for example, C. E. Mees and T. H. James, *The Theory of the Photographic Process*, 3rd Ed., pages 36–43 (1966, published by Macmillan Co.).

Typical examples of the water-soluble rhodium salt used in this invention are rhodium chloride, rhodium trichloride, rhodium ammonium chloride. Other complex salts of rhodium can also be used in this invention. The period of adding the rhodium salt in this invention is limited to the time before finishing the first ripening of the silver halide emulsion during production of the silver halide emulsion and it is preferred that the rhodium salt is added to a silver halide emulsion during the formation of the silver halide grains. Also, it is suitable that the additional amount of the rhodium salt be more than $1\times10^{-6}$ mole per mole of silver, and it is preferable that the addition amount of the rhodium salt be more than $1\times10^{-5}$ mole, particularly preferably in the range of $5\times10^{-5}$ to $1\times10^{-3}$ mole, per mole of silver.

Examples of methods of reacting a soluble silver salt and a soluble halide in this invention include a single jet method, a double jet method, or a combination of these methods. A method of forming silver halide grains under the presence of excessive silver ions (i.e., a so-called reversal mixing method) can be also employed. One mode of the double jet method employed in this invention is a so-called controlled double jet method, i.e., a method of maintaining a fixed pAg of a liquid phase wherein the silver halide is formed. In accordance with this method, a silver halide emulsion having a regular crystal form and almost uniform grain sizes is obtained.

It is preferred to carry out the formation of silver halide grains in an acid state. It has been found by our experiments that the effect or merit of this invention is reduced under a neutral or alkaline state. A preferred pH range is lower than 6, more preferably lower than 5.

Useful binders and protective colloids or photographic silver halide emulsions include gelatin as well as other hydrophilic colloids. Examples of such hydrophilic colloids include proteins such as gelatin derivatives, graft polymers of gelatin and other polymers, albumin and casein; cellulose derivatives such as hydroxyethyl cellulose, carboxymethyl cellulose and cellulose sulfuric acid esters; sugar derivatives such as sodium alginate and starch derivatives; and various kinds of synthetic hydrophilic high molecular materials including homopolymers or copolymers of polyvinyl alcohol, polyvinyl alcohol partial acetal, poly-N-vinylpyrrolidone, polyacrylic acid, polymethacrylic acid, polyacrylamide, polyvinyl imidazole and polyvinyl pyrazole.

Useful gelatins include acid-processed gelatin in addition to lime-processed gelatin as well as hydrolyzed products of gelatin or enzyme-decomposition products of gelatin. Gelatin derivatives which can be used in connection with this invention include various derivatives obtained by reacting gelatin and various compounds such as acid halides, acid anhydrides, isocyanates, bromoacetic acid, alkane sultones, vinyl-sulfonamides, maleinimide compounds, polyalkylene oxides, epoxy compounds, etc. Practical examples of these materials are described in, for example, U.S. Pat. Nos. 2,614,928, 3,132,945, 3,186,846, and 3,312,553, British Pat. Nos. 861,414, 1,033,189 and 1,005,784, Japanese Patent Publication No. 26845/67, etc.

Useful gelatin graft polymers include graft polymers obtained by grafting gelatin to a homopolymer or copolymer of a vinylic monomer such as acrylic acid, methacrylic acid, the ester or amide derivatives of them, acrylonitrile and styrene. In particular, a graft polymer of gelatin and a polymer having a compatibility with gelatin to some extent, for example, a polymer of acrylic acid, methacrylic acid, acrylamide, methacrylamide, hydroxyalkylmethacrylate, etc., is preferably used. Practical examples of these graft polymers are described in, for example, U.S. Pat. Nos. 2,763,625, 2,831,767 and 2,956,884.

Typical synthetic hydrophilic high molecular materials are described in, for example, West German patent application (OLS) No. 2,312,708, U.S. Pat. Nos.

3,620,751 and 3,879,250, and Japanese Patent Publication No. 7561/68.

Silver halide emulsions used in this invention may be chemically sensitized. However, in order to improve handleability in a bright room, it is preferred that the silver halide emulsion used in this invention be not chemically sensitized. When applying chemical sensitization, it is possible to use sulfur sensitization, reduction sensitization, gold sensitization, or a combination thereof.

The polyalkylene oxide compounds used in this invention include the condensation products of a polyalkylene oxide composed of an alkylene oxide having 2 to 4 carbon atoms, such as ethylene oxide, propylene-1,2-oxide, butylene-1,2-oxide, etc., preferably composed of at least 10 units of ethylene oxide with a compound having at least one active hydrogen atom, such as water, an aliphatic alcohol, an aromatic alcohol, a fatty acid, an organic amine, a hexitol derivative, etc., and block copolymers of two or more polyalkylene oxides. Preferred examples of polyalkylene oxide compounds used in this invention include:

polyalkylene glycols,
polyalkylene glycol alkyl ethers,
polyalkylene glycol aryl ethers,
polyalkylene glycol alkylaryl ethers,
polyalkylene glycol esters,
polyalkylene glycol fatty acid amides,
polyalkylene glycol amines,
polyalkylene glycol·block copolymers,
polyalkylene glycol graft polymers, etc.

It is necessary that the molecular weight of the polyalkylene oxide compound used in this invention is 600 or more.

The polyalkylene oxide chain contained in the molecule of the polyalkylene oxide compound is not limited to one but two or more such chains may be contained in the molecule. In this case, each polyalkylene oxide chain may be composed of less than 10 alkylene oxide units but the total alkylene oxide units in the molecule must be at least 10. When the polyalkylene oxide compound has two or more polyalkylene oxide chains in the molecule thereof, each chain may be composed of different alkylene oxide units, for example, ethylene oxide and propylene oxide. It is preferred that the polyalkylene oxide compound used in this invention has 14 to 100 alkylene oxide units.

Preferred examples of the polyalkylene oxide compound used in this invention include:

$HO(CH_2CH_2O)_{90}H$ III-1
$C_4H_9O(CH_2CH_2O)_{15}H$ III-2
$C_{12}H_{25}O(CH_2HC_2O)_{15}H$ III-3
$C_{18}H_{37}O(CH_2CH_2O)_{15}H$ III-4
$C_{18}H_{37}O(CH_2CH_2O)_{40}H$ III-5
$C_8H_{17}CH{=}CHC_8H_{16}O(CH_2CH_2O)_{15}H$ III-6

III-7

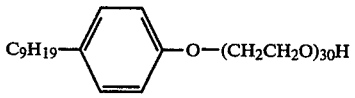

III-8

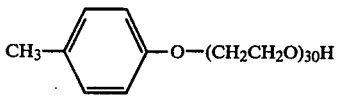

-continued

III-9

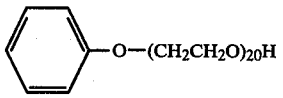

$C_{11}H_{23}COO(CH_2CH_2O)_{80}H$ III-10
$C_{11}H_{23}COO(CH_2CH_2O)_{24}OCC_{11}H_{23}$ III-11

III-12

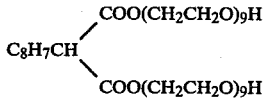

$C_{11}H_{23}CONH(CH_2CH_2O)_{15}H$ III-13

III-14

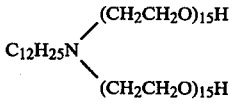

$C_{14}H_{29}N(CH_2)(CH_2CH_2O)_{24}H$ III-15

III-16

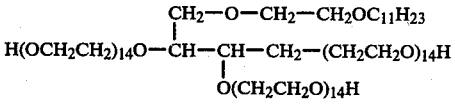

III-17

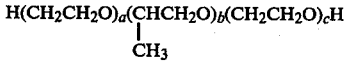

a + b + c = 50
b:a + c = 10:9

III-18

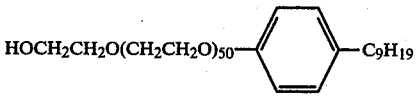

III-19

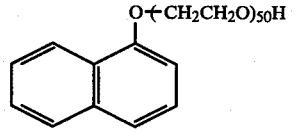

$HO(CH_2CH_2O)_a(CH_2CH_2CH_2CH_2O)_b(CH_2CH_2O)_cH$ III-20 a + c = 30, b = 14

III-21

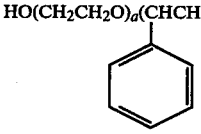

a + c = 50, b = 8

III-22

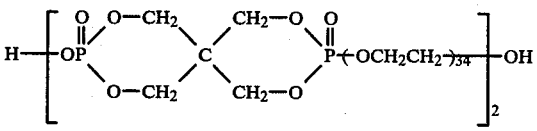

III-23

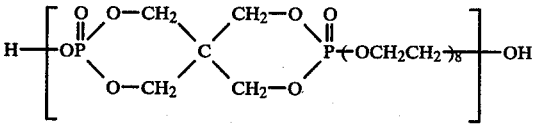

$HO(CH_2CH_2O)_{34}H$ III-24 as described in Japanese patent application (OPI) Nos. 156423/75, 108130/77, and 3217/78. These polyalkylene oxide compounds may be used solely or in various combinations.

When adding these polyalkylene oxide compounds to silver halide emulsions, the compound may be added to a silver halide emulsion as an aqueous solution thereof of a proper concentration or a solution thereof in a low-boiling point organic solvent which is miscible with water at a proper period before coating the silver halide emulsion, preferably after chemical ripening of the emulsion. The polyalkylene oxide compounds may be added to non-light-sensitive hydrophilic colloid layers in place of adding to silver halide emulsion layers, such as interlayers, protective layers, filter layers, etc.

The addition amount of the polyalkylene oxide compound used in this invention is in the range of $1\times10^{-5}$ mole to $1\times10^{-2}$ mole and is preferably in the range of $5\times10^{-5}$ mole to $5\times10^{-3}$ mole, per mole of silver halide.

It has also been discovered that when a benzotriazole compound and/or a mercapto compound, which is usually used as an antifoggant, is used together with the polyalkylene oxide compound in this invention, the quality of the letter image is further improved. These compounds are effective only when they are used in light-sensitive materials. This effect is not a simple antifogging effect and also is not an effect for increasing the contrast for the characteristic curve of the light-sensitive material but is for improving the quality of the letter image. A preferred example of these compounds is a benzotriazole compound which may be substituted by one or more substituents selected from an alkyl group (e.g., a methyl group, an ethyl group, a heptyl group, etc.), an alkoxy group, a halogen atom, an acyl group, an acylamino group, a carbamoyl group, a sulfamoyl group, an aryl group, etc., and benzotriazole substituted by an alkyl group having 1 to 3 carbon atoms is particularly effective. The effective addition amount of the compound is $1\times10^{-4}$ to $1\times10^{-2}$ mole, preferably $5\times10^{-4}$ to $5\times10^{-3}$ mole, per mole of silver.

Other preferred examples of the foregoing compounds are the mercapto compounds shown by the following general formula:

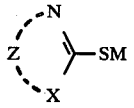

wherein M represents a hydrogen atom, —$NH_4$ group, or an alkali metal; X represents —NR group (wherein R represents a hydrogen atom, an alkyl group which may be substituted, an aryl group which may be substituted, or an aralkyl group which may be substituted), a sulfur atom, or an oxygen atom; and Z represents an atomic group necessary for forming a 5-membered heterocyclic ring (e.g., tetrazole, triazole, imidazole, and thiadiazole) or a 5-membered heterocyclic ring condensed with a benzene ring (e.g., benzimidazole, benzthiazole, and benzoxazole) and these heterocyclic rings may be substituted by an alkyl group, an alkoxy group, a carboxy group, a sulfo group, a hydroxyl group, an amino group, a nitro group, a halogen atom, a carbamoyl group, an alkylthio group, a mercapto group, etc. Preferred compounds in the foregoing compounds are the compounds of the above general formula wherein Z is tetrazole, triazole, thiadiazole, benzimidazole, or benzthiazole and the most preferred compound is the tetrazole compound. Preferred examples of these compounds are shown below.

1

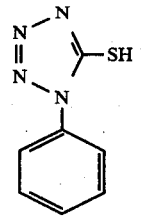

2

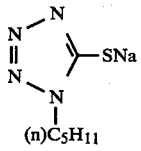

3

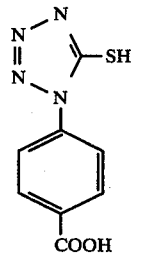

4

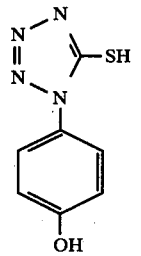

5

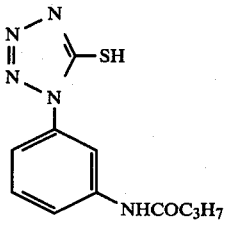

6

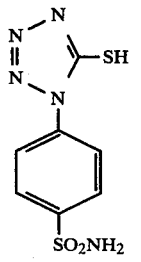

-continued

7

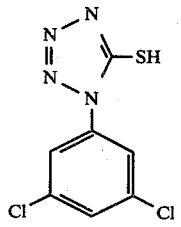

8

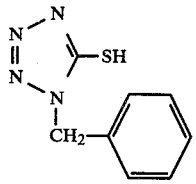

9

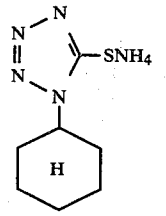

10

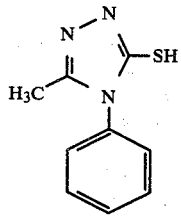

11

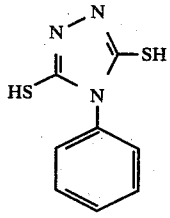

12

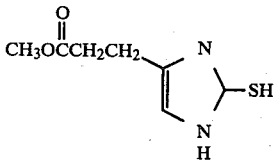

13

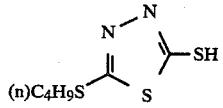

14

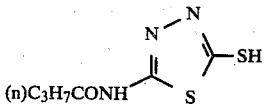

15

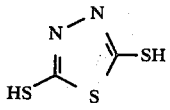

-continued

16

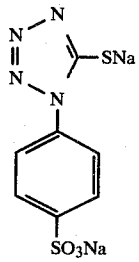

17

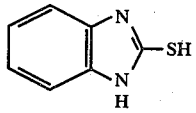

18

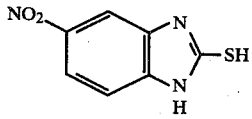

19

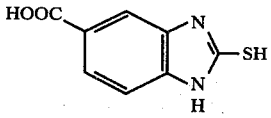

20

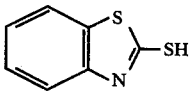

21

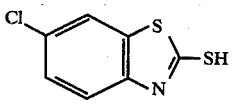

22

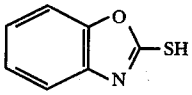

The effective addition amount of the foregoing compound is in the range of $5\times10^{-5}$ to $5\times10^{-3}$ mole per mole of silver.

The photographic silver halide emulsions used in this invention may further contain water-soluble dyes as filter dyes or as dyes for irradiation prevention and other various purposes. Useful examples of these dyes include oxonol dyes, hemioxonol dyes, styryl dyes, merocyanine dyes, cyanine dyes, and azo dyes. In particular, oxonol dyes, hemioxonol dyes, and merocyanine dyes are useful. Practical examples of the dyes which can be used in this invention are described in British Pat. Nos. 584,609 and 1,777,429, Japanese Patent Application (OPI) Nos. 85130/73, 99620/74 and 114420/74, and U.S. Pat. Nos. 2,274,782, 2,533,472, 2,956,879, 3,148,187, 3,177,078, 3,247,127, 3,540,887, 3,575,704, 3,653,905 and 3,718,472.

Furthermore, the photographic silver halide emulsions used in this invention may contain inorganic or organic hardening agents. Examples of such hardening agents include chromium salts (chromium alum, chromium acetate, etc.), aldehydes (formaldehyde, glyoxal, glutaraldehyde, etc.), N-methylol compounds (dimethylolurea, methyloldimethylhydantoin, etc.), dioxane derivatives (2,3-dihydroxydioxane, etc.), active vinyl compounds (1,3,5-triacryloyl-hexahydro-s-triazine, bis-(vinylsulfonyl) methyl ether, N,N'-methylenebis[β-(vinylsulfonyl)propionamide], etc.), active halogen compounds (2,4-dichloro-6-hydroxy-s-triazine, etc.), mucohalogenic acids (mucochloric acid, mucophenoxychloric acid, etc.), isoxazoles, dialdehyde starch and 2-chloro-6-hydroxytriazinylated gelatin. They may be used solely or as a combination of them. Practical examples of these compounds are described in U.S. Pat. Nos. 1,870,354, 2,080,019, 2,726,162, 2,870,013, 2,983,611, 2,992,109, 3,047,394, 3,057,723, 3,103,437, 3,321,313, 3,325,287, 3,362,827, 3,539,644 and 3,543,292, British Pat. Nos. 676,628, 825,544 and 1,270,578, German Pat. Nos. 872,153 and 1,090,427, and Japanese Patent Publication Nos. 7133/59 and 1872/71.

The photographic silver halide emulsions used in this invention may further contain various known surface active agents for various purposes such as for coating aids, static prevention, improving sliding property, improving emulsified dispersion, adhesion prevention, and improving photographic characteristics.

Examples of the surface active agents used in this invention are nonionic surface active agents such as saponin (steroid series), polyalkylene glycol alkylamines or amides, polyethylene oxide addition products of silicone, glycidol derivatives (e.g., alkenylsuccinic acid polyglyceride, alkylphenol polyglyceride, etc.), fatty acid esters of polyhydric alcohols, alkyl esters of sugar, alkylurethanes of sugar, alkyl ethers of sugar, etc.; anionic surface active agents having acid groups such as carboxy group, sulfo group, phospho group, sulfuric acid ester group, phosphoric acid ester group, etc., for example, triterpenoid series saponin, alkyl carboxylates, alkyl sulfonates, alkylbenzenesulfonates, alkylnaphthalenesulfonates, alkylsulfuric acid esters, alkylphosphoric acid esters, N-acyl-N-alkyltaurines, sulfosuccinic acid esters, sulfoalkyl polyoxyethylene alkylphenyl ethers, polyoxyethylene alkylphosphoric acid esters, etc.; amphoteric surface active agents such as aminoacids, aminoalkylsulfonic acids, aminoalkylsulfuric acid esters, aminoalkylphosphoric acid esters, alkylbetaines, amine imides, amine oxides, etc.; and cationic surface active agents such as alkylamine salts, aliphatic or aromatic quaternary ammonium salts; heterocyclic quaternary ammonium salts such as pyridinium, imidazolium, etc., and phosphonium salts or sulfonium salts containing aliphatic or heterocyclic rings.

Practical examples of these surface active agents are described in U.S. Pat. Nos. 2,240,472, 2,831,766, 3,158,484, 3,210,191, 3,294,540 and 3,507,660, British Pat. Nos. 1,012,495, 1,022,878, 1,179,290 and 1,198,450, Japanese Patent Application (OPI) No. 117414/75, U.S. Pat. Nos. 2,739,891, 2,823,123, 3,068,101, 3,415,649, 3,666,478 and 3,756,828, British Pat. No. 1,397,218, U.S. Pat. Nos. 3,133,816, 3,441,413, 3,475,174, 3,545,974, 3,726,683 and 3,843,368, Belgian Pat. No. 731,126, British Pat. Nos. 1,138,514, 1,159,825 and 1,374,780, Japanese Patent Publication Nos. 378/65, 379/65 and 13822/68, U.S. Pat. Nos. 2,288,226, 2,944,900, 3,253,919, 3,671,247, 3,772,021, 3,589,906, 3,666,478 and 3,754,924, West German Patent Application (OLS) No. 1,961,638 and Japanese Patent Application (OPI) No. 59025/75.

The photographic silver halide emulsions used in this invention may further contain a dispersion of a water-insoluble or water sparingly soluble synthetic polymer for improving the dimensional stability of the light-sensitive materials of this invention. Examples of the synthetic polymers used in this invention include polymers composed of monomer units such as alkyl acrylate, alkyl methacrylate, alkoxyalkyl acrylate, alkoxyalkyl methacrylate, glycidyl acrylate, glycidyl methacrylate, acrylamide, methacrylamide, vinyl esters (e.g., vinyl acetate, etc.), acrylonitrile, olefin and styrene, solely or in combination thereof or in combination of the foregoing monomer and acrylic acid, methacrylic acid, α,β-unsaturated dicarboxylic acid, hydroxyalkyl acrylate, hydroxyalkyl methacrylate, sulfoalkyl acrylate, sulfoalkyl methacrylate and styrene-sulfonic acid, etc. These polymers are described in, for example, U.S. Pat. Nos. 2,376,005, 2,739,137, 2,853,457, 3,062,674, 3,411,911, 3,488,708, 3,525,620, 3,607,290, 3,635,715 and 3,645,740, and British Pat. Nos. 1,186,699 and 1,307,373.

Any black-and-white development process can be applied to the light-sensitive materials of this invention. Examples of useful developing agents include dihydroxybenzene series developing agents, 1-phenyl-3-pyrazolidone series developing agents, and p-aminophenol series developing agents and they can be used solely or in combination thereof (e.g., a combination of a 1-phenyl-3-pyrazolidone and a dihydroxybenzene or a combination of p-aminophenol and a dihydroxybenzene). The light-sensitive materials of this invention may be processed by a so-called infection developer using hydroquinone and a sulfite ion buffer such as carbonyl bisulfite, etc.

Examples of the foregoing dihydroxybenzene series developing agent include hydroquinone, chlorohydroquinone, bromohydroquinone, isopropylhydroquinone, toluhydroquinone, methylhydroquinone, 2,3-dichlorohydroquinone and 2,5-dimethylhydroquinone. Examples of the foregoing 1-phenyl-3-pyrazolidone series developing agents include 1-phenyl-3-pyrazolidone, 4,4-dimethyl-1-phenyl-3-pyrazolidone, 4-hydroxymethyl-4-methyl-1-phenyl-3-pyrazolidone, and 4,4-dihydroxymethyl-1-phenyl-3-pyrazolidone. Examples of the p-aminophenol series developing agents include p-aminophenol, and N-methyl-p-aminophenol.

To the developer is added a compound giving a free sulfite ion as preservatives, such as sodium sulfite, potassium sulfite, potassium metahydrogensulfite and sodium metahydrogensulfite. With respect to infectious developers, it is possible to use sodium formaldehyde hydrogen sulfite which provides only a small number of free sulfite ions in the developer.

Useful alkaline agents for a developer used in this invention include potassium hydroxide, sodium hydroxide, potassium carbonate, sodium carbonate, sodium acetate, potassium tertiary phosphate, diethanolamine and triethanolamine. The pH of the developer is usually adjusted to a level ranging from higher than 9, preferably higher than 9.7 up to 13.

The developer used in this invention may further contain organic compounds which are known as antifoggant or development inhibitor. Examples of such organic compounds include azoles such as benzothiazolium salt, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles and mercaptotetrazoles (in particular, 1-phenyl-5-mercaptotetrazole); mercaptopyrimidines; mercaptotriazines; thioketo compounds such as oxazolinethione; azaindenes such as triazaindenes, tetraazaindenes (in particular, 4-hydroxy-substituted (1,3,3a,7)tetraazaindenes) and pentaazaindenes;

benzenethiosulfonic acid; benzenesulfinic acid; benzenesulfonic acid amide; and sodium 2-mercaptobenzimidazole-5-sulfonate.

A developer particularly suitable for processing the light-sensitive materials of this invention is the developer containing 0.05 to 0.5 mole/liter, preferably 0.1 to 0.4 mole/liter of a dihydroxybenzene as the primary developing agent and containing no auxiliary developing agent (e.g., a 1-phenyl-3-pyrazolidone or a p-aminophenol) or containing less than 0.05 g/liter of the auxiliary developing agent. The developer further contains more than 0.25 mole/liter of a free sulfite ion, more than 20 mg/liter of 5- or 6-nitroindazole, and also an alkali in an amount sufficient for maintaining the pH of the developer above 10.5 up to 12.5 (in particular, above 11.5). In this invention, the sole use of a dihydroxybenzene (in particular, hydroquinone) containing no auxiliary developing agent is preferred.

This developer can quickly form an image having excellent letter image quality. Furthermore, this developer has good stability, because it can comprise a large quantity of sulfite ion, as compared with the conventional lithographic developer in which a concentration of sulfite ion is reduced to trace amount (i.e., less than 0.25 mole/l) by which a high-contrast image can be formed. This developer can provide a high-contrast image utilized together with the light-sensitive material of the present invention.

It is preferred that the developer used in this invention contains polyalkylene oxide of the same kind as described above as a development inhibitor. For example, the developer can contain polyethylene oxide having a molecular weight of 1,000 to 10,000 in an amount of 0.1 to 10 g/liter.

It is preferred to incorporate nitrilotriacetic acid, ethylenediaminetetraacetic acid, triethylenetetraminehexaacetic acid, diethylenetetraminepentaacetic acid, etc., to the developer used in this invention as a water softener.

The fix solution may be a solution having a composition generally used in the field of photography.

Fixing agents used for the fix solution include thiosulfates, thiocyanates, and organic sulfur compounds which are known to be effective as a fixing agent.

The fix solution may further contain a water-soluble aluminum salt as a hardening agent.

The fix solution can also contain a complex of ethylenediaminetetraacetic acid and a trivalent iron ion as an oxidizing agent.

The processing temperature and the processing time are properly selected. The temperature is generally in the range of 18° C. to 50° C. and, on the other hand, it is preferred to perform quick processing in 15 to 120 seconds using a so-called automatic processor.

The light-sensitive material of this invention can be handled in a bright room and can give a high-sensitive and high-contrast image when printed by a light source enriched with ultraviolet rays, which are required for reproduction films for contact work, since the light-sensitive material has the halogen composition, the mean grain size, and the addition amount of a rhodium salt in desired values respectively. Further, the light-sensitive material can provide such an unexpected effect that the line width of a line image can be faithfully nega-posi transformed at an exposure amount capable of faithfully nega-posi transforming a dot area during an image-letter superimposition since the light-sensitive material contains a polyalkylene oxide compound or a derivative thereof.

The developing process of this invention for processing the light-sensitive material of this invention with developer having foregoing specific composition can quickly form the letter image having excellent image quality. Further, the developing process of this invention is desirable in that the developer used for the process can be used for a long period of time since the developer is stable.

The invention will now be explained in more detail by the following examples. However, the invention is not limited th these examples.

EXAMPLE 1

Solution I: 600 ml of water, 18 g of gelatin, pH 3.0.
Solution II: 200 g of $AgNO_3$, 800 ml of water.

Using the foregoing Solution I and Solution II, seven kinds of Silver Halide Emulsions A to G were prepared.

(1) Emulsion A (Br: 5 mole%, grain size: 0.25μ, Rh: $1\times10^{-4}$ mole/mole silver)

Solution $III_A$: 7 g of KBr, 69 g of NaCl, 40 mg of $NH_4RhCl_6$, 800 ml of water.

To Solution I maintained at 42° C. were simultaneously added Solution II and Solution $III_A$ at a definite speed over a period of 30 minutes. After removing soluble salts from the silver halide emulsion thus formed by a manner well-known in this art, gelatin was added to the emulsion and 2-methyl-4-hydroxy-1,3,3a,7-tetraazaindene was added thereto as a stabilizer without performing chemical ripening. The mean grain size of the silver halide emulsion was 0.25 μm, the amount of the emulsion obtained was 1 kg, and the amount of gelatin contained therein was 60 g.

(2) Emulsion B (Br: 15 mole%, grain size: 0.25μ, Rh: $1\times10^{-4}$ mole/mole silver)

Solution $III_B$: 21 g of KBr, 62 g of NaCl, 40 mg of $NH_4RhCl_6$, 800 ml of water.

Emulsion B was prepared in the same manner as Emulsion A except for using Solution $III_B$ in place of Solution $III_A$.

When the contact work is carried out by higher image transformation work referred to as so-called "spread and choke" by which a letter, symbol, etc., encircled with clear frame is formed at dot-image area or solid black area with utilizing the silver halide photographic light-sensitive materials of the present invention and the process of developing them according to the present invention, an extremely superior image can be obtained.

(3) Emulsion C (Br: 30 mole%, grain size: 0.25μ, Rh: $1\times10^{-4}$ mole/mole silver)

Solution $III_C$: 42 g of KBr, 52 g of NaCl, 40 mg of $NH_4RhCl_6$, 800 ml of water.

Emulsion C was prepared in the same manner as Solution $III_A$ except for using solution $III_C$ in place of Solution $III_A$.

(4) Emulsion D (Br: 15 mole%, grain size: 0.45μ, Rh: $1\times10^{-4}$ mole/mole silver)

Emulsion D was prepared in the same manner as Emulsion B except that the temperature of Solution I was changed to 65° C. Emulsion D was the same as Emulsion B except that the grain size of Emulsion D was 0.45 μm.

(5) Emulsion E (Br: 5 mole%, grain size: 0.25μ, Rh: $1\times10^{-4}$ mole/mole silver added after washing)

Solution $III_E$: 7 g of KBr, 69 g of NaCl, 800 ml of water.

After forming silver halide grains using Solution $III_E$ in the same manner as Emulsion A and removing soluble salts thus formed, gelatin was added to the emulsion and after further adding thereto 4 ml of an aqueous 1% $NH_4RhCl_6$ solution, 2-methyl-4-hydroxy-1,3,3a,7-tetraazaindene was added to the emulsion as a stabilizer without performing chemical ripening.

(6) Emulsion F (Br: 5 mole%, grain size: 0.25μ, Rh: $1\times10^{-7}$ mole/mole silver)

Solution $III_F$: 7 g of KBr, 69 g of NaCl, 0.04 mg of $NH_4RhCl_6$, 800 ml of water.

Emulsion F was prepared in the same manner as Emulsion A except for using Solution $III_F$ in place of Solution $III_A$.

(7) Emulsion G (Br: 5 mole%, grain size: 0.25μ, Rh: $2\times10^{-6}$ mole/mole silver)

Solution $III_G$: 7 g of KBr, 69 g of NaCl, 0.8 mg of $NH_4RhCl_6$, 800 ml of water.

Emulsion G was prepared in the same manner as Emulsion A except for using Solution $III_G$ in place of Solution $III_A$.

To each of the silver halide emulsions thus prepared were added a hardening agent, 2-hydroxy-4,6-dichloro-1,3,5-triazine.sodium salt and $1\times10^{-4}$ mole/mole silver of Polyalkylene Oxide Compound III-7 and the resultant emulsion was coated on a polyethylene terephthalate film at a silver coverage of 4.5 g/m$^2$.

Thus, Films A to G were prepared as sample films.

Furthermore, to Emulsion A were added the hardening agent as described above and also Polyalkylene Oxide Compound III-19 in an amount of 16 mg per 50 g of the emulsion ($1.0\times10^{-4}$ mole/mole silver) and the resultant emulsion was similarly coated on a polyethylene terephthalate film to provide a sample film, Film H.

Still further, to Emulsion A was added the hardening agent as above-described and the resultant emulsion was coated on a polyethylene terephthalate film without adding the polyethylene oxide compound to provide a sample film, Film I.

Then, after exposing each of the sample films by a P-607 type printer (made by Dainippon Screen Mfg. Co., Ltd.) using the original having the structure shown in the FIGURE, the film was processed by means of an FG-25L automatic processor containing lithographic developer HS-1 (made by Fuji Photo Film Co., Ltd.) under optimum developing conditions (27° C., 1 min 40 sec). Furthermore, the following Developer (I) was placed in automatic developer FG-25 RA (made by Fuji Photo Film Co., Ltd.) and the film was processed under optimum conditions (38° C., 20 sec).

| Developer (I): | |
|---|---|
| Potassium bromide | 2.0 g |
| Potassium hydroxide | 20 g |
| Potassium carbonate | 35 g |
| Potassium sulfite | 80 g |
| Hydroquinone | 20 g |
| Triethylene glycol | 30 g |
| Polyethylene glycol (molecular weight: 4,000) | 2.0 g |
| 5-Nitroindazole | 0.1 g |
| Water to make | 1 l |
| | (pH 11.7) |

The results obtained are shown in Table 1.

TABLE 1

| Film | Amount of AgCl in Silver Halide (mole %) | Grain Size (μm) | Concentration of Rhodium Salt (mole/mole Ag) | Polyalkylene Oxide Compound | Letter Image Quality: Lithographic Developer | Letter Image Quality: Developer I |
|---|---|---|---|---|---|---|
| A * | 95 | 0.25 | $1\times10^{-4}$ | III-7 | 3 | 5 |
| B * | 85 | " | " | " | 2 | 4 |
| C | 70 | " | " | " | 1 | 1 |
| D | 85 | 0.45 | " | " | 1 | 1 |
| E | 95 | 0.25 | " (added after washing) | " | 1 | 1 |
| F | " | " | $1\times10^{-7}$ | " | 1 | 1 |
| G * | " | " | $2\times10^{-6}$ | " | 2 | 3 |
| H * | " | " | $1\times10^{-4}$ | III-19 | 2 | 4 |
| I | " | " | " | None | 1 | 1 |

*Symbol indicates a sample of the present invention.

The grade of letter image quality formed under a condition under which a dot area of 50% is aptitudinally exposed on a reproduction film for contact work as a dot area of 50% using the original as shown in the FIGURE is determined with the following evaluation grades.

The grade 1: a letter having a width of broader than 150 μm is accurately reproduced.

The grade 2: a letter having a width of broader than 120 μm is accurately reproduced.

The grade 3: a letter having a width of broader than 90 μm is accurately reproduced.

The grade 4: a letter having a width of broader than 60 μm is accurately reproduced.

The grade 5: a letter having a width of 30 μm is accurately reproduced.

Any grade higher than 2 is at a practically usable level.

As is clear from the results shown in Table 1, a good letter image quality is shown only when adding more than $10^{-6}$ mole/mole silver of a rhodium salt to a silver halide emulsion containing more than 80% AgCl before finishing the first ripening in the presence of the polyalkylene oxide compound.

EXAMPLE 2

Solution I: 1,000 ml of water, 20 g of gelatin, pH 4.0.

Solution II: 200 g of $AgNO_3$, 600 ml of water.

Solution III: 4.2 g of KBr, 75 g of NaCl, 20 mg of $RhCl_3$, 600 ml of water.

To an aqueous gelatin solution, Solution I maintained at 45° C. was simultaneously added Solution II and Solution III at a definite speed over a period of 30 minutes. After removing soluble salts by a conventional manner well-known in this art from the silver halide emulsion thus obtained, gelatin was added to the emulsion and then 2-methyl-4-hydroxy-1,3,3a,7-tetraazaindene was added thereto as a stabilizer without applying chemical ripening. The mean grain size of the silver halide emulsion was 0.28 μm, the amount of the emulsion was 1 kg, and the amount of gelatin contained in the emulsion was 70 g. After adding thereto a hardening agent, 2-hydroxy-4,6-dichloro-1,3,5-triazine.sodium salt, the resultant emulsion was coated on a polyethylene terephthalate film at a silver coverage of 4.5 g/m$^2$. Thus, a sample film was prepared as Film J.

Preparation of Film K

By following the same procedure as when preparing Film J while adding $2\times10^{-4}$ mole/mole Ag of Polyalkylene Oxide Compound III-17 to the silver halide emulsion, the sample film of this invention was prepared as Film K.

Preparation of Film L

By following the same procedure as when preparing Film J while adding $2\times10^{-4}$ mole/mole Ag of Polyalkylene Oxide Compound III-17 and $3\times10^{-3}$ mole/mole Ag of 5-methylbenzotriazole to the silver halide emulsion, the sample film of this invention was prepared as Film L.

Preparation of Film M

By following the same procedure as when preparing Film J while adding $2\times10^{-4}$ mole/mole Ag of Polyalkylene Oxide Compound III-17 and $4\times10^{-4}$ mole/mole Ag of 1-phenyl-5-mercaptotetrazole to the silver halide emulsion, the sample film of this invention was prepared as Film M.

Preparation of Film N

By following the same procedure as when preparing Film J while adding $2\times10^{-4}$ mole/mole Ag of Polyalkylene Oxide Compound III-17, $3\times10^{-3}$ mole/mole Ag of 5-methylbenzotriazole, and $4\times10^{-4}$ mole/mole Ag of 1-phenyl-5-mercaptotetrazole to the silver halide emulsion, the sample film of this invention was prepared as Film N.

After exposing each of the sample films thus prepared by means of a P-607 type printer (made by Dainippon Screen Mfg. Co., Ltd.) using the original having the structure as shown in the FIGURE, the film was developed by one of seven kinds of the developers having the compositions shown in the following table using automatic processor FG 25 RA (made by Fuji Photo Film Co., Ltd.), fixed, washed, and dried. Furthermore, for comparing the stabilities of the developers, each of the developer was placed in the automatic processor for 4 days, and then the foregoing processing was followed using the developer.

The aptitude developing time of each sample film, the letter image quality of each sample thus processed, and the sensitivity of each sample in the case of using the developer stored for 4 days were measured and the results are shown in Table 2.

| | Developer | | | | | | |
|---|---|---|---|---|---|---|---|
| | A (g) | B (g) | C (g) | D (g) | E (g) | F (g) | G (g) |
| Ethylenediamine-tetraacetic acid tetrasodium salt | 2.0 | " | " | " | " | " | " |
| Potassium bromide | 2.0 | " | " | " | " | " | " |
| Potassium hydroxide | 8.0 | 2.0 | 20.0 | " | " | 8.0 | " |
| Potassium carbonate | 35.0 | " | " | " | " | " | " |

-continued

| | Developer | | | | | | |
|---|---|---|---|---|---|---|---|
| | A (g) | B (g) | C (g) | D (g) | E (g) | F (g) | G (g) |
| Formaldehyde sodium hydrogen-sulfite | — | 50.0 | — | — | — | — | — |
| Potassium sulfite | 80.0 | 5.0 | 80.0 | " | 5.0 | 80.0 | " |
| 1-Phenyl-3-pyrazolidone | 0.2 | — | — | 0.2 | — | — | — |
| Hydroquinone | 20.0 | " | " | " | " | " | " |
| Triethylene glycol | 30.0 | " | " | " | " | " | " |
| Polyethylene glycol (molecular weight: 3,000) | 2.0 | " | " | " | " | " | " |
| 5-Nitroindazole | 0.1 | — | 0.1 | " | " | " | — |
| 5-Methylbenzo-triazole | — | — | — | — | — | — | 0.1 |
| Water to make | 1 l | " | " | " | " | " | " |
| pH adjusted by NaOH to | 10.5 | 10.2 | 11.7 | 11.7 | 11.7 | 10.5 | 11.7 |

(": same as left)

TABLE 2

| Developer | A | B | C | D | E | F | G |
|---|---|---|---|---|---|---|---|
| | Film J (Comparison Sample) | | | | | | |
| Aptitude developing time (sec) | 20 | 60 | 20 | 20 | 20 | 60 | 20 |
| Letter image quality | 1 | 1 | 1 | 1 | 1 | 1 | 1 |
| Sensitivity after 4 days (for 100 by fresh developer) | 100 | 50 | 100 | 100 | 20 | 100 | 100 |
| | Film K | | | | | | |
| Aptitude developing time (sec) | 20 | 60 | 20 | 20 | 20 | 60 | 20 |
| Letter image quality | 1.5 | 2 | 4 | 1.5 | 4 | 2.5 | 2 |
| Sensitivity after 4 days (for 100 by fresh developer) | 100 | 50 | 100 | 100 | 20 | 100 | 100 |
| | Film L | | | | | | |
| Aptitude developing time (sec) | 20 | 60 | 20 | 20 | 20 | 60 | 20 |
| Letter image quality | 2 | 2.5 | 4.5 | 2 | 4.5 | 3 | 3 |
| Sensitivity after 4 days (for 100 by fresh developer) | 100 | 50 | 100 | 100 | 20 | 100 | 100 |
| | Film M | | | | | | |
| Aptitude developing time (sec) | 20 | 60 | 20 | 20 | 20 | 60 | 20 |
| Letter image quality | 2 | 2.5 | 4.5 | 2 | 4.5 | 3 | 3 |
| Sensitivity after 4 days (for 100 by fresh developer) | 100 | 50 | 100 | 100 | 20 | 100 | 100 |
| | Film N | | | | | | |
| Aptitude developing time (sec) | 20 | 60 | 20 | 20 | 20 | 60 | 20 |
| Letter image quality | 2.5 | 3 | 5 | 2.5 | 5 | 3.5 | 4 |
| Sensitivity after 4 days (for 100 by fresh developer) | 100 | 50 | 100 | 100 | 20 | 100 | 100 |

The aptitude developing time refers to the developing time at which the best letter image quality is obtained by the combination of the developer and film when the film is developed by the developer at a developing temperature of 32° C. and the image quality was checked every five seconds.

The grade of letter image quality is determined with the same evaluation grades as explained in Example 1 in regard to Table 1.

The sensitivity after 4 days shown in Table 2 is the exposure time necessary for giving the foregoing aptitude exposure when using the developer stored for 4 days shown in comparison with the necessary exposure time when using the fresh developer.

As is clear from the results shown in Table 2, film J (comparison sample) does not provide good letter image quality with any of the developers. On the other hand, Sample Films K, L, M and N of this invention provide good letter image quality with any of the Developers A, B, C, D, E, F and G. Among these developers, Developer C (which is shown as a particularly preferred developer in this specification) clearly provides good letter image qualities. Developer D contains 0.2 g/liter of 1-phenyl-3-pyrazolone as an auxiliary developing agent. Developer D provides inferior letter image quality as compared to Developer C. Developer E undergoes a large reduction in developer sensitivity when stored for 4 days to the low sulfite ion concentration and thus Developer E is unstable. Developer F has a low pH as compared to that of Developer C and the letter image quality provided by Developer F is inferior to that provided by Developer C. Further, the developing time with Developer F is longer than that with Developer C. Furthermore, Developer G contains 5-methylbenzotriazole in palce of 5-nitroindazole and the letter image quality obtained with Developer G is inferior to that with Developer C. Therefore, Table 2 clearly shows that Developer C gives particularly preferred results with respect to providing good letter image quality in a short developing time and has been found to be a stable developer.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material comprising a support having thereon a silver halide emulsion layer containing a silver halide emulsion in which at least 80 mole% of the whole silver halide is composed of silver chloride, the mean grain size thereof is less than 0.4 μm, and which contains more than $1\times10^{-6}$ mole of a water-soluble rhodium salt per mole of silver at an optional period before finishing the first ripening in the production step for the silver halide emulsion, said silver halide photographic light-sensitive material further containing $1\times10^{-5}$ to $1\times10^{-2}$ mole of polyalkylene oxide having a molecular weight of at least 600 or a derivative thereof per mole of silver.

2. A silver halide photographic light-sensitive material as claimed in claim 1, wherein the polyalkylene oxide is present within the silver halide emulsion layer.

3. A silver halide photographic light-sensitive material as claimed in claim 1, further comprising a hydrophilic colloid layer which contains the polyalkylene oxide.

4. A silver halide photographic light-sensitive material as claimed in claim 1, further comprising an additional compound selected from the group consisting of a benzotriazole compound and a mercapto compound.

5. A developing process, comprising the steps of:

providing a silver halide photographic light-sensitive material comprised of a support having thereon a silver halide emulsion layer containing a silver halide emulsion in which at least 80 mole% of the whole silver halide is composed of silver chloride, the mean grain size thereof is less than 0.4 μm, and which contains more than $1\times10^{-6}$ mole of a water-soluble rhodium salt per mole of silver at an optional period before finishing the first ripening step in the production step of the silver halide emulsion, said silver halide photographic light-sensitive material further containing $1\times10^{-5}$ to $1\times10^{-2}$ mole of polyalkylene oxide having a molecular weight of at least 600 or a derivative thereof per mole of silver;

imagewise exposing the photographic material: and processing the exposed material with a developer containing 0.05 to 0.5 mole/liter of a dihydroxybenzene series developing agent, 0 to 0.05 g/liter of an auxiliary developing agent, at least 0.25 mole/liter of a free sulfite ion, at least 20 mg/liter of 5- or 6-nitroindazole, and an alkali of an amounts sufficient for keeping the pH of the developer above 10.5.

6. A developing process as claimed in claim 5, wherein the dihydroxybenzene series developing agent is present in an amount within the range of 0.1 to 0.4 mole/liter.

7. A developing process as claimed in claim 5, wherein the pH of the developer is adjusted to a level ranging from higher than 10.5 up to 12.5.

8. A developing process as claimed in claim 7, wherein the pH of the developer is adjusted to a level ranging from higher than 11.5 up to 12.5.

9. A developing process as claimed in claim 5, wherein the developer contains solely a dihydroxybenzene containing no auxiliary developing agent.

10. A developing process as claimed in claim 9, wherein the dihydroxybenzene is hydroquinone.

* * * * *